United States Patent [19]

McCollum et al.

[11] 3,960,708

[45] June 1, 1976

[54] PROCESS FOR UPGRADING A HYDROCARBON FRACTION

[75] Inventors: John D. McCollum, Munster, Ind.; Leonard M. Quick, Park Forest South, Ill.

[73] Assignee: Standard Oil Company, Chicago, Ill.

[22] Filed: May 31, 1974

[21] Appl. No.: 474,913

[52] U.S. Cl. ..... 208/121; 208/112; 208/113; 208/213; 208/251 R; 208/254 R

[51] Int. Cl.[2] ..... C01G 11/02; C01G 17/00

[58] Field of Search ..... 208/121, 112, 216–217, 208/251, 108, 110–111, 208 R, 254

[56] References Cited

UNITED STATES PATENTS

| | | | |
|---|---|---|---|
| 2,211,944 | 8/1940 | Andrews et al. | 208/121 |
| 3,453,206 | 7/1969 | Gatsis | 208/210 |
| 3,501,396 | 3/1970 | Gatsis | 208/216 |
| 3,586,621 | 6/1971 | Pitchford et al. | 208/112 |
| 3,676,331 | 7/1972 | Pitchford | 208/112 |
| 3,687,838 | 8/1972 | Seitzer | 208/10 |

*Primary Examiner*—Delbert E. Gantz
*Assistant Examiner*—G. E. Schmitkons
*Attorney, Agent, or Firm*—James R. Henes; Arthur G. Gilkes; William T. McClain

[57] ABSTRACT

A process for upgrading a hydrocarbon fraction by contacting the hydrocarbon fraction with a dense-water-containing fluid at a temperature in the range of from about 600°F. to about 900°F. in the absence of externally supplied hydrogen and of pretreatment of the hydrocarbon fraction and in the presence of a sulfur-resistant catalyst.

17 Claims, 1 Drawing Figure

PROCESS FOR UPGRADING A HYDROCARBON FRACTION

RELATED APPLICATIONS

This application is related to the following applications which were filed simultaneously with this application and by the same applicants: 474,907; 474,908; 474,909; 474,927; 474,928.

BACKGROUND OF THE INVENTION

1. Field of the Invention

This invention involves a process for cracking, desulfurizing, and demetalating a hydrocarbon fraction.

2. Description of the Prior Art

As a result of the increasing demand for light hydrocarbon fractions, there is much current interest in more efficient methods for converting the heavier hydrocarbon fractions and products of refining into lighter materials. The conventional methods of accomplishing this, such as catalytic cracking, coking, thermal cracking and the like, always result in the production of more highly refractory materials.

It is known that such heavier hydrocarbon fractions and products and such refractory materials can be converted to lighter materials by hydrocracking. Hydrocracking processes are most commonly employed on liquefied coals or heavy residual or distillate oils for the production of substantial yields of low boiling saturated products and to some extent of intermediates which are utilizable as domestic fuels, and still heavier cuts which find uses as lubricants. These destructive hydrogenation processes or hydrocracking processes may be operated on a strictly thermal basis or in the presence of a catalyst.

However, the application of the hydrocracking technique has in the past been fairly limited because of several interrelated problems. Conversion of heavy petroleum products and hydrocarbon fractions to more useful products by the hydrocracking technique is complicated by the presence of certain contaminants in heavier hydrocarbon fractions and refinery products. Petroleum crude oils and the heavier hydrocarbon fractions and/or distillates obtained therefrom, particularly heavy vacuum gas oils, oil extracted from tar sands, and topped or reduced crudes, contain nitrogenous, sulfurous, and organo-metallic compounds in exceedingly large quantities. The presence of sulfur- and nitrogen-containing and organo-metallic compounds in crude oils and various refined petroleum products and hydrocarbon fractions has long been considered undesirable.

For example, because of the disagreeable odor, corrosive characteristics and combustion products (particularly sulfur dioxide) of sulfur-containing compounds, sulfur removal has been of constant concern to the petroleum refiner. Further, the heavier hydrocarbons are largely subjected to hydrocarbon conversion processes in which the conversion catalysts are, as a rule, highly susceptible to poisoning by sulfur compounds. This has led in the past to the selection of low-sulfur crudes whenever possible. With the necessity of utilizing heavy, high sulfur hydrocarbon fractions in the future, economical desulfurization processes are essential. This need is further emphasized by recent and proposed legislation which seeks to limit sulfur contents of industrial, domestic, and motor fuels.

Generally, sulfur appears in feedstocks in one of the following forms: mercaptans, hydrogen sulfides, sulfides, disulfides, and as part of complex ring compounds. The mercaptans and hydrogen sulfides are more reactive and are generally found in the lower boiling fractions, for example, gasoline, naphtha, kerosene, and light gas oil fractions. There are several well-known processes for sulfur removal from such lower boiling fractions. However, sulfur removal from higher boiling fractions has been a more difficult problem. Here, sulfur is present for the most part in less reactive forms as sulfides, disulfides, and as part of complex ring compounds of which thiophene is a prototype. Such sulfur compounds are not susceptible to the conventional chemical treatments found satisfactory for the removal of mercaptans and hydrogen sulfide and are particularly difficult to remove from heavy hydrocarbon materials.

Nitrogen is undesirable because it effectively poisons various catalytic composites which may be employed in the conversion of heavy hydrocarbon fractions. In particular, nitrogen-containing compounds are effective in suppressing hydrocracking. Moreover, nitrogenous compounds are objectionable because combustion of fuels containing these impurities possibly contributes to the release of nitrogen oxides which are noxious and corrosive and present a serious problem with respect to pollution of the atmosphere. Consequently, removal of the nitrogenous contaminants is most important and makes practical and economically attractive the treatment of contaminated stocks.

However, in order to remove the sulfur or nitrogen or to convert the heavy residue into lighter more valuable products, the crude oil or heavy hydrocarbon fraction is ordinarily subjected to a hydrocatalytic treatment. This is conventionally done by contacting the oil or hydrocarbon fraction with hydrogen at an elevated temperature and pressure and in the presence of a catalyst. Unfortunately, unlike distillate stocks which are substantially free from asphaltenes and metals, the presence of asphaltenes and metal-containing compounds in the heavy hydrocarbon fractions leads to a relatively rapid reduction in the activity of the catalyst to below a practical level. The presence of these materials in the charge stock results in the deposition of metal-containing containing coke on the catalyst particles, which prevents the charge from coming in contact with the catalyst and thereby, in effect, reduces the catalytic activity. Eventually, the on-stream period must be interrupted, and the catalyst must be regenerated or replaced with fresh catalyst.

Particularly objectionable is the presence of iron in the form of soluble organometallic compounds, such as is present frequently to a relatively high parts-per-million level in Western United States crude oils and residuum fractions. Even when the concentration of iron porphyrin complexes and other iron organometallic complexes is relatively small — that is, on the order of parts per million — their presence causes serious difficulties in the refining and utilization of heavy hydrocarbon fractions. The presence of an appreciable quantity of the organometallic iron compounds in feedstocks undergoing catalytic cracking causes rapid deterioration of the cracking catalysts and changes the selectivity of the cracking catalysts in the direction of more of the charge stock being converted to coke. Also, the presence of an appreciable quantity of the organo-iron compounds in feedstocks undergoing hydroconversion (such as hydrotreating or hydrocracking) causes harmful effects in the hydroconversion processes, such as deactivation of the hydroconversion catalyst and, in many instances, plugging or increasing of the pressure drop in fixed bed hydroconversion reactors due to the deposition of iron compounds in the interstices between catalyst particles in the fixed bed of catalyst.

Additionally metallic contaminants such as nickel- and vanadium-containing compounds are found as innate contaminants in practically all crude oils associated with the high Conradson carbon asphaltic and/or asphaltenic portion of the crude. When the crude oil is topped to remove the light fractions boiling above about 450°–650°F., the metals are concentrated in the residual bottoms. If the residuum is then further treated, such metals adversely affect catalysts. When the oil is used as a fuel, the metals also cause poor fuel oil performance in industrial furnaces by corroding the metal surfaces of the furnace.

There have been numerous references to processes for hydrogenating, cracking, desulfurizing, denitrifying, demetalating, and generally upgrading hydrocarbon fractions by processes involving water. For example, Gatsis, U.S. Pat. No. 3,453,206 (1969) discloses a multistage process for hydrorefining heavy hydrocarbon fractions for the purpose of eliminating and/or reducing the concentration of sulfurous, nitrogenous, organo-metallic, and asphaltenic contaminants therefrom. The nitrogenous and sulfurous contaminants are converted to ammonia and hydrogen sulfide. The stages comprise pretreating the hydrocarbon fraction, in the absence of a catalyst, with a mixture of water and externally supplied hydrogen at a temperature above the critical temperature of water and a pressure of at least 1000 pounds per square inch gauge and then reacting the liquid product from the pretreatment stage with externally supplied hydrogen at hydrorefining conditions and in the presence of a catalytic composite. The catalytic composite comprises a metallic component composited with a refractory inorganic oxide carrier material of either synthetic or natural origin, which carrier material has a medium-to-high surface area and a well-developed pore structure. The metallic component can be vanadium, niobium, tantalum, molybdenum, tungsten, chromium, iron, cobalt, nickel, platinum, palladium, iridium, osmium, rhodium, ruthenium, and mixtures thereof.

Gatsis, U.S. Pat. No. 3,501,396 (1970) discloses a process for desulfurizing and denitrifying oil which comprises mixing the oil with water at a temperature above the critical temperature of water up to about 800°F. and at a pressure in the range of from about 1000 to about 2500 pounds per square inch gauge and reacting the resulting mixture with externally supplied hydrogen in contact with a catalytic composite. The catalytic composite can be characterized as a dual function catalyst comprising a metallic component such as iridium, osmium, rhodium, ruthenium and mixtures thereof and an acid carrier component havin cracking activity. An essential feature of this method is the catalyst being acidic in nature. Ammonia and hydrogen sulfide are produced in the conversion of nitrogenous and sulfurous compounds, respectively.

Pritchford et al., U.S. Pat. No. 3,586,621 (1971) discloses a method for converting heavy hydrocarbon oils, residual hydrocarbon fractions, and solid carbonaceous materials to more useful gaseous and liquid products by contacting the material to be converted with nickel spinel catalyst promoted with a barium salt of an organic acid in the presence of steam. A temperature in the range of from 600°F. to about 1000°F. and a pressure in the range of from 200 to 3000 pounds per square inch gauge are employed.

Pritchford, U.S. Pat. No. 3,676,331 (1972) discloses a method for upgrading hydrocarbons and thereby producing materials of low molecular weight and of reduced sulfur content and carbon residue by introducing water and a catalyst system containing at least two components into the hydrocarbon fraction. The water can be the natural water content of the hydrocarbon fraction or can be added to the hydrocarbon fraction from an external source. The water-to-hydrocarbon fraction volume ratio is preferably in the range of from about 0.1 to about 5. At least the first of the components of the catalyst system promotes the generation of hydrogen by reaction of water in the water gas shift reaction and at least the second of the components of the catalyst system promots reaction between the hydrogen generated and the constituents of the hydrocarbon fraction. Suitable materials for use as the first component of the catalyst system are the carboxylic acid salts of barium, calcium, strontium, and magnesium. Suitable materials for use as the second component of the catalyst system are the carboxylic acid salts of nickel, cobalt, and iron. The process is carried out at a reaction temperature in the range of from about 750°F. to about 850°F. and at a pressure of from about 300 to about 4000 pounds per square inch gauge in order to maintain a principal portion of the crude oil in the liquid state.

Wilson et al., U.S. Pat. No. 3,733,259 (1973) discloses a process for removing metals, asphaltenes, and sulfur from a heavy hydrocarbon oil. The process comprises dispersing the oil with water, maintaining this dispersion at a temperature between 750°F. and 850°F. and at a pressure between atmospheric and 100 pounds per square inch gauge, cooling the dispersion after at least one-half hour to form a stable water-asphaltene emulsion, separating the emulsion from the treated oil, adding hydrogen, and contacting the resulting theaded oil with a hydrogenation catalyst at a temperature between 500°F. and 900°F. and at a pressure between about 300 and 3000 pounds per square inch gauge.

It has also been announced that the semi-government Japan Atomic Energy Research Institute, working with the Chisso Engineering Corporation, has developed what is called a "simple, low-cost, hot-water, oil desulfurization process" and to have "sufficient commercial applicability to compete with the hydrogenation process." The process itself consists of passing oil through a pressurized boiling water tank in which water is heated up to approximately 250°C., under pressure of about 100 atmospheres. Sulfides in oil are then separated when the water temperature is reduced to less than 100°C.

Thus far, no one has disclosed the method of this invention for upgrading hydrocarbon fractions, which permits operation at lower than conventional temperatures, without an external source of hydrogen, and without preparation or pretreatment of the hydrocarbon fraction, such as, desalting or demetalation.

SUMMARY OF THE INVENTION

This invention is a process for cracking, desulfurizing, and demetalating a hydrocarbon fraction containing paraffins, olefins, olefinequivalents, or acetylenes, as such or as substituents on ring compounds, which comprises contacting the hydrocarbon fraction with a water-containing fluid at a temperature in the range of from about 600°F. to about 900°F. in the absence of externally supplied hydrogen and of pretreatment of the hydrocarbon fraction and in the presence of an externally supplied, sulfur-resistant catalyst selected from the group consisting of at least one basic metal carbonate, basic metal hydroxide, transition metal oxide, oxide-forming transition metal salt, and combinations thereof. The density of water in the water-containing fluid is at least 0.10 gram per milliliter, and sufficient water is present to serve as an effective solvent for the hydrocarbon fraction. Essentially all the sulfur removed from the hydrocarbon fraction is in the form of elemental sulfur.

Density of water in the water-containing fluid is preferably at least 0.15 gram per milliliter and most preferably at least 0.2 gram per milliliter. The temperature is preferably at least 705°F., the critical temperature of water. The hydrocarbon fraction and water-containing fluid are contacted preferably for a period of time in the range of from about 1 minute to about 6 hours, more preferably in the range of from about 5 minutes to about 3 hours and most preferably in the range of from about 10 minutes to about 1 hours. The weight ratio of the hydrocarbon fraction-to-water in the water containing fluid is preferably in the range of from about 1:1 to about 1:10 and more preferably in the range of from about 1:2 to about 1:3. The water-containing fluid is preferably substantially water and more preferably water.

The transition metal in the oxide and salt in the catalyst is selected preferably from the group consisting of a transition metal of Group IV, VB VIB, and VIIB in the Periodic Chart, more preferably from the group consisting of vanadium, chromium, manganese, iron, titanium, molybdenum, copper, zirconium, niobium, tantalum, rhenium, and tungsten, and most preferably from the group consisting of chromium, manganese, titanium, tantalum, and tungsten. The metal in the basic metal carbonate and hydroxide is selected preferably from the group consisting of alkali and alkaline earth metals and more preferably from the group consisting of sodium and potassium. The catalyst is present in a catalytically effective amount which is equivalent to a concentration level in the water in the water-containing fluid preferably in the range of from about 0.01 to about 3.0 weight percent and more preferably in the range of from about 0.10 to about 0.50 weight percent.

DETAILED DESCRIPTION

Figure 1:
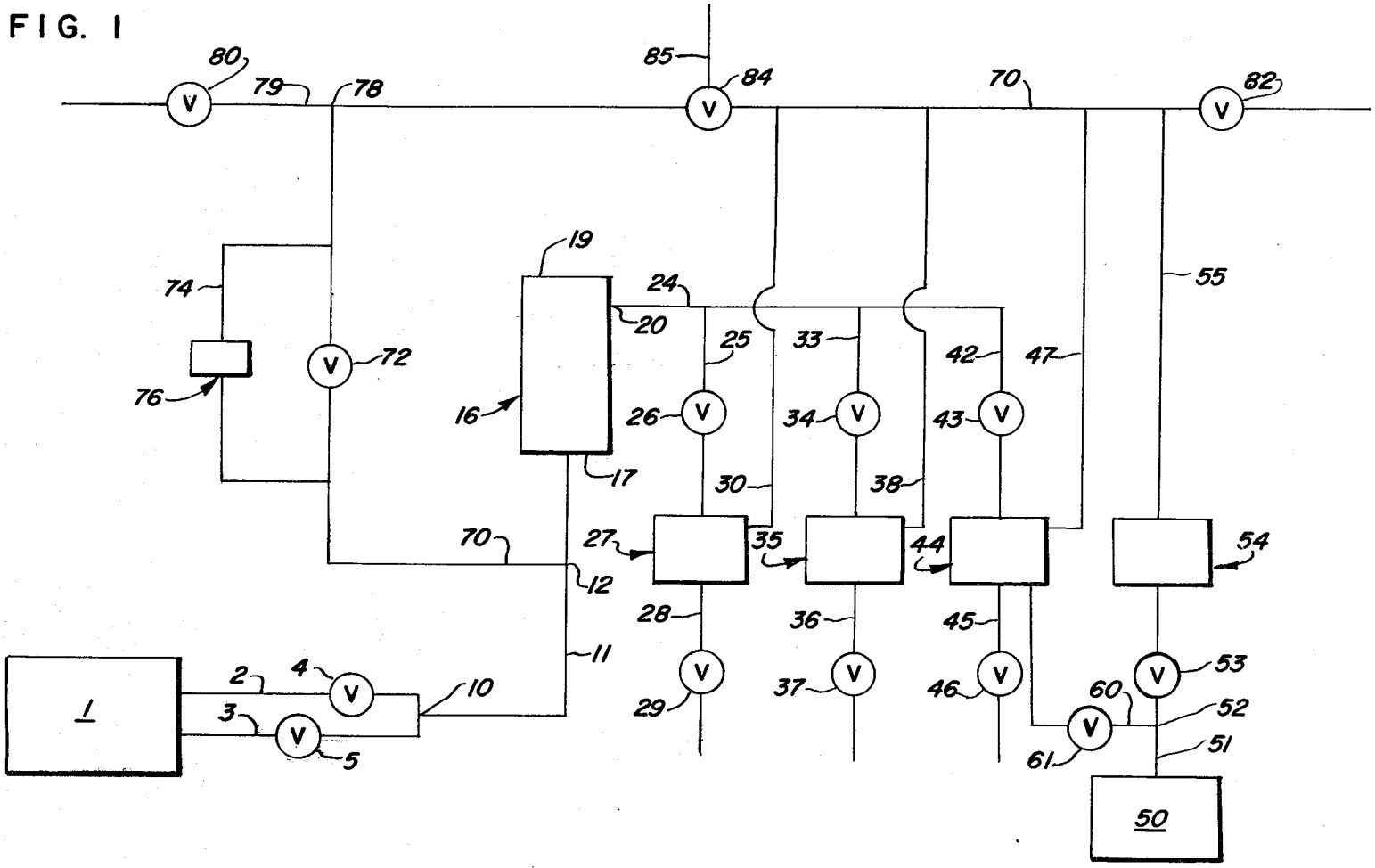
FIG. 1 is a schematic diagram of the flow system used in the method of this invention for semi-continuously processing a hydrocarbon fraction.

It has been found that hydrocarbons containing paraffins, olefins, olefin-equivalents — for example, alcohols and aldehydes — or acetylenes, as such or as substituents on ring compounds, can be upgraded, cracked, desulfurized, and demetalated by contacting such hydrocarbons with a dense-water-containing phase, either gas or liquid, at a reaction temperature in the range of from about 600°F. to about 900°F. in the presence of a catalyst and in the absence of an external source of hydrogen. This method is applicable to the whole range of hydrocargon fractions, including both light materials and heavy materials such as gas oil, residual oils, tar sands oil, oil shale kerogen extracts, and liquefied coal products.

We have found that, in orde to effect chemical conversions of heavy hydrocarbon fractions into lighter, more useful hydrocarbon fractions by the method of this invention — which involves processes characteristically occurring in solution rather than typical pyrolytic processes — the water in the dense-water-containing fluid phase must have a high solvent power and liquid-like densities — for example, at least 0.1 gram per milliliter — rather than vapor-like densities. Maintenance of the water in the dense-water-containing phase at a relatively high density, whether at temperatures below or above the critical temperature of water, is essential to the method of this invention. The density of the water in the dense-water-containing phase must be at least 0.1 gram per milliliter.

The high solvent power of dense fluids is discussed in the monograph "The Principles of Gas Extraction" by P. F. M. Paul and W. S. Wise, published by Mills and Boon Limited in London, 1971, of which Chapters 1 through 4 are incorporated herein by reference. For example, the difference in the solvent power of steam and of dense gaseous water maintained at a temperature in the region of the critical temperature of water and at an elevated pressure is substantial. Even normally insoluble inorganic materials, such as silica and alumina, commence to dissolve appreciably in "supercritical water" — that is, water maintained at a temperature above the critical temperature of water — so long as a high water density is maintained.

Enough water must be employed so that there is sufficient water in the sense-water-containing phase to serve as an effective solvent for the hydrocarbons. The water in the dense-water-containing phase can be in the form either of liquid water or of dense gaseous water. The vapor pressure of water in the dense-water-containing phase must be maintained at a sufficiently high level so that the density of water in the dense-water-containing phase is at least 0.1 gram per milliliter.

We have found that, with the limitations imposed by the size of the reaction vessels we employed in this work, a weight ratio of the hydrocarbon fraction-to-water in the dense-water-containing phase in the range of from about 1:1 to about 1:10 is preferable and a ratio in the range of from about 1:2 to about 1:3 is more preferable.

A particularly useful water-containing fluid contains water in combination with an organic compound such as biphenyl, pyridine, a partly hydrogenated aromatic oil, or a mono- or polyhydric compound such as methyl alcohol. The use of such combinations extends the limits of solubility and rates of dissolution so that cracking, desulfurization, and demetalation can occur even more readily. Furthermore, the component other than water in the dense-water-containing phase can serve as a source of hydrogen, for example, by reaction with water.

The catalyst employed in the method of this invention is effective when added in an amount equivalent to a concentration in the water of the water-containing fluid in the range of from about 0.01 to about 3.0 weight percent and preferably in the range of from about 0.10 to about 0.50 weight percent.

The catalyst may be added as a solid and slurried in the reaction mixture or as a water-soluble salt — for example manganese chloride or potassium permanganate — which produces the corresponding oxide under the conditions employed in the method of this invention. Alternately, the catalyst can be deposited on a support and used as such in a fixed-bed flow configuration or slurried in the water containing fluid.

This process can be performed either as a batch process or as a continuous or semi-continuous flow process. Contact times between the hydrocarbon fraction and the dense-water-containing phase — that is, residence time in a batch process or inverse solvent space velocity in a flow process — of from the order of minutes up to about 6 hours are satisfactory for effective cracking, desulfurization, and demetalation of the hydrocarbon fraction.

EXAMPLES 1–14

Examples 1–14 involve batch processing of different types of hydrocarbon feedstocks under a variety of conditions and illustrates that the method of this invention effectively cracks, desulfurizes, and demetalates hydrocarbons. Unless otherwise specified, the following procedure was used in each case. The hydrocarbon feed, water and, if used, the components of the catalyst system were loaded at ambient temperature into a 300-milliliter Hastelloy alloy C Magne-Drive autoclave in which the reaction mixture was to be mixed. The components of the catalyst system were added as solutes in the water or as solids in slurries in the water. Unless otherwise specified, sufficient water was added in each Example so that, at the reaction temperature and pressure and in the reaction volume used, the density of the water was at least 0.1 gram per milliliter.

The autoclave was flushed with inert argon gas and was then closed. Such inert gas was also added to raise the pressure of the reaction system. The contribution of argon to the total pressure at ambient temperature is called the argon pressure.

The temperature of the reaction system was then raised to the desired level and the dense-water-containing fluid phase was formed. Approximately 28 minutes were required to heat the autoclave from ambient temperature to 660°F. Approximately 6 minutes were required to raise the temperature from 660°F. to 700°F. Approximately another 6 minutes were required to rasie the temperature of 700°F. to 750°F. When the desired final temperature was reached, the temperature was held constant for the desired period of time. This final constant temperature and the period of time at this temperature are defined as the reaction temperature and reaction time, respectively. During the reaction time, the pressure of the reaction system increased as the reaction proceeded. The pressure at the start of the reaction time is defined as the reaction pressure.

After the desired reaction time at the desired reaction temperature and pressure, the dense-water-containing fluid phase was de-pressurized and was flash-distilled from the reaction vessel. removing the gas, water, and "light" ends, and leaving the "heavy" ends, catalyst, if present, and other solids in the reaction vessel. The "light" ends were the hydrocarbon fraction boiling at or below the reaction temperature and the "heavy" ends where the hydrocarbon fraction boiling above the reaction temperature.

The gas, water, and light ends were trapped in a pressure vessel cooled by liquid nitrogen. The gas was removed by warming the pressure vessel to room temperature and then was analyzed by mass spectroscopy, gas chromatography, and infra-red. The water and light ends were then purged from the pressure vessel by means of compressed gas and occasionally also by heating the vessel. Then the water and light ends were separated by decantation. Alternately, this separation was postponed until a later stage in the procedure. Gas chromatograms were run on the light ends.

The heavy ends and solids were washed from the reaction vessel with chloroform, and the heavy ends dissolved in this solvent. The solids were then separated from the solution containing the heavy ends by filtration.

After separating the chloroform from the heavy ends by distillation, the light ends and heavy ends were combined. If the water had not already been separated from the light ends, then it was separated from the combined light and heavy ends by centrifugation and decantation. The combined light and heavy ends were analyzed for their nickel, vanadium, and sulfur content, carbon-hydrogen atom ratio (C/H), and API gravity. The water was analyzed for nickel and vanadium, and the solids were analyzed for nickel, vanadium, and sulfur. X-ray fluoresence was used to determine nickel, vanadium, and sulfur.

Examples 1–5 involve straight tar sands oil, and Examples 6–9 involve topped tar sands oil. Topped tar sands oil is the straight tar sands oil used in Examples 1–5 but from which approximately 25 weight percent of light material has been removed. Examples 10–13 involve C atmospheric residual oil. Example 14 involves C vacuum residual oil. The compositions of the hydrocarbon feeds employed are shown in Table 1. The experimental conditions used and the results of analyses of the products obtained in these Examples are shown in Tables 2 and 3, respectively. A 300-milliliter Hastelloy alloy C Magne-Drive autoclave was employed as the reaction vessel in these Examples.

Comparison of the results shown in Table 3 indicates the desulfurization and demetalation of the hydrocarbon feed occurred and that the hydrocarbon feed was cracked, producing gases, light ends, heavy ends, and solid residue, even when no catalyst was added from an external source. In such case, the extend of removal of sulfur and metals increased with the reaction time was increased from 1 to 3 hours. Beyond that time, the extent of desulfurization decreased with increasing reaction time. Addition of a catalyst substantially increased the extent of desulfurization and demetalation.

When the water density was at least 0.1 gram per milliliter — for example, when the hydrocarbon fraction-to-water weight ratio was 1:3 — the sulfur which was removed from the hydrocarbon feed appeared as elemental sulfur and not as sulfur dioxide or as hydrogen sulfide. At lower water densities — for example, when the hydrocarbon-to-water weight ratio was 4:1 — part of the removed sulfur appeared as hydrogen sulfide. This clearly indicates a change in the mechanism of desulfurization of organic compounds on contact with a dense-water-containing phase, depending upon the water density of the dense-water-containing phase. Further, when the hydrocarbon fraction-to-water weight ratio was 4:1, there was an adverse shift in the distribution of hydrocarbon products and a lesser extent of desulfurization.

The total weight percent of gases and compositions of the gas products obtained in several of the Examples are indicated in Table 4.

TABLE 1

| Components | Tar Sands Oils Straight | Tar Sands Oils Topped | Atmospheric Residual Oils Khafji | Atmospheric Residual Oils C | Atmospheric Residual Oils Cyrus | C Vacuum Residual Oil |
|---|---|---|---|---|---|---|
| Sulfur[1] | 4.56 | 5.17 | 3.89 | 3.44 | 5.45 | 4.64 |
| Vanadium[2] | 182 | 275 | 93 | 25 | 175 | 54 |
| Nickel[2] | 74 | 104 | 31 | 16 | 59 | 34 |
| Carbon[1] | 83.72 | 82.39 | 84.47 | 85.04 | 84.25 | 84.88 |
| Hydrogen[1] | 10.56 | 9.99 | 10.99 | 11.08 | 10.20 | 10.08 |
| H/C atom ratio | 1.514 | 1.455 | 1.56 | 1.56 | 1.45 | 1.43 |
| API gravity[3] | 12.2 | 7.1 | 14.8 | 15.4 | 9.8 | 5.4 |
| Liquid fraction,[1] boiling up to 650°F. | 29.4 | 9.7 | 10.6 | 12.0 | 6.9 | 9.1 |

Footnotes
[1]weight percent.
[2]parts per million.
[3]°API.

TABLE 2

| Example | Reaction Time[1] | Reaction Temperature[2] | Reaction Pressure[3] | Argon Pressure[3] | Catalyst | Amount of Catalyst Added[4] | Amount of Water[4] | Hydrocarbon-to-Water Weight Ratio |
|---|---|---|---|---|---|---|---|---|
| 1 | 6 | 752 | 4400 | 450 | — | — | 90 | 1:3 |
| 2 | 3 | 752 | 4350 | 400 | — | — | 90 | 1:3 |
| 3 | 1 | 752 | 4350 | 400 | — | — | 90 | 1:3 |
| 4 | 2 | 752 | 4200 | 400 | NaOH | 0.04 | 80 | 1:3 |
| 5 | 1 | 752 | 4300 | 400 | $MnO_2$ | 0.30 | 91 | 1:3 |
| 6 | 1 | 752 | 4300 | 400 | — | — | 90 | 1:3 |
| 7 | 3 | 752 | 4300 | 400 | — | — | 90 | 1:3 |
| 8 | 2 | 752 | 4350 | 400 | NaOH | 0.04 | 80 | 1:3 |
| 9 | 1 | 752 | 4250 | 400 | $MnO_2$ | 0.30 | 90 | 1:3 |
| 10 | 1 | 752 | 4450 | 400 | KOH | 0.5 | 90 | 1:3 |
| 11 | 1 | 752 | 4550 | 400 | KOH | 1 | 90 | 1:3 |
| 12 | 6 | 710 | 2600 | 450 | — | — | 30 | 4:1 |
| 13 | 6 | 710 | 3600 | 450 | — | — | 90 | 1:3 |
| 14 | 1 | 752 | 4150 | 400 | KOH | 1 | 90 | 1:3 |

Footnotes
[1]hours.
[2]°F.
[3]pounds per square inch gauge.
[4]grams.

TABLE 3

| Example | Product Composition[1] Gas | Light Ends | Heavy Ends | Solids | Percent Removal of[2] Sulfur | Nickel | Vanadium | H/C Atom Ratio | API Gravity[3] | Weight Balance[4] |
|---|---|---|---|---|---|---|---|---|---|---|
| 1 | 3.7 | 84.2 | 5.7 | 6.4 | 56 | — | — | — | — | 97.2 |
| 2 | 11.2 | 75.2 | 8.6 | 5.0 | 63 | 95 | 74 | 1.451 | 20.5 | 100.2 |
| 3 | 1.3 | 70.6 | 27.1 | 1.0 | 36 | 69 | 77 | 1.362 | 20.5 | 99.4 |
| 4 | 2.7 | 72.1 | 23.0 | 2.2 | 74 | 85 | 82 | — | — | 99.7 |
| 5 | 7.7 | 68.6 | 22.4 | 1.3 | 80 | 80 | 96 | — | — | 99.8 |
| 6 | 1.0 | 62.9 | 39.4 | 0.1 | 39 | 42 | 75 | — | — | 99.9 |
| 7 | 5.9 | 67.2 | 20.0 | 6.9 | 49 | 77 | 96 | 1.418 | 12.5 | 99.7 |
| 8 | 5.0 | 59.9 | 32.2 | 2.9 | 37 | 91 | 92 | — | — | 100.0 |
| 9 | 5.7 | 59.8 | 33.2 | 1.3 | 80 | 86 | 93 | — | — | 100.3 |
| 10 | 1.3 | 54.3 | 36.9 | 7.5 | 79 | — | 92 | — | — | 100.6 |
| 11 | 2.0 | 51.7 | 39.7 | 6.7 | 82 | — | 90 | — | — | 101.1 |
| 12 | 2.5 | 35.3 | 62.1 | 0.7 | 30 | — | — | — | — | 98.4 |
| 13 | 4.7 | 53.0 | 38.0 | 1.3 | 32 | — | — | — | — | 100.7 |
| 14 | 1.3 | 29.7 | 60.8 | 8.2 | 90 | 96 | 24 | — | — | 100.1 |

Footnotes
[1]weight percent of hydrocarbon feed.
[2]These values were obtained from analyses of the combined light and heavy ends.
[3]°API.
[4]total weight percent of hydrocarbon and water feeds and catalyst recovered as product and water.

TABLE 4

| Example | Reaction Time[1] | Composition of the Gas Products [2] Hydrogen | Carbon Dioxide | Methane | Total Weight Percent of Gas |
|---|---|---|---|---|---|
| 2 | 3 | 3.3 | 5.2 | 6.9 | 11.2 |
| 3 | 1 | 2.8 | 3.1 | 3.4 | 1.3 |
| 6 | 1 | 1.0 | 3.8 | 8.4 | 1.0 |

TABLE 4-continued

| Example | Reaction Time[1] | Composition of the Gas Products [2] Hydrogen | Carbon Dioxide | Methane | Total Weight Percent of Gas |
|---|---|---|---|---|---|
| 7 | 3 | 3.0 | 5.6 | 7.5 | 5.9 |

Footnotes
[1]hours.
[2]mole percent of gas.

The chief component of the gases was argon which was used in the pressurization of the reactor and which is not reported in Table 4. Generally, increasing the reaction time resulted in increased yields of gaseous products.

Successive exposure of the catalysts of this invention to hydrocarbons containing sulfur contaminants did not cause a decrease in the catalytic efficiency of the catalysts.

EXAMPLES 15–24

Examples 15–24 involve semi-continuous flow processing at 752°F. of straight tar sands oil under a variety of conditions. The flow system used in these Examples is shown in the Figure. To start a run, ⅛-inch diameter inert, spherical alundum balls or irregularly shaped, catalytic titanium oxide chips having 2 weight percent of ruthenium deposited thereon were loaded into a 21.5-inch long, 1-inch outside diameter, and 0.25-inch inside diameter vertical Hastelloy alloy C pipe reactor 16. The alundum balls served merely to provide an inert surface on which metals to be removed from the hydrocarbon feed could deposit. Top 19 was then closed, and a furnace (not shown) was placed around the length of pipe reactor 16. Pile reactor 16 had a total effective heated volume of approximately 12 milliliters, and the packing material had a total volume of approximately 6 milliliters, leaving approximately a 6-milliliter free effective heated space in pipe reactor 16.

All valves, except 53 and 61, were opened, and the flow system was flushed with argon or nitrogen. Then, with valves 4, 5, 29, 37, 46, 53, 61, and 84 closed and with Annin valve 82 set to release gas from the flow system when the desired pressure in the system was exceeded, the flow system was brought up to a pressure in the range of from about 1000 to about 2000 pounds per square inch gauge by arbon or nitrogen entering the system through valve 80 and line 79. Then valve 80 was closed. Next, the pressure of the flow system was brought up to the desired reaction pressure by opening valve 53 and pumping water through Haskel pump 50 and line 51 into water tank 54. The water served to further compress the gas in the flow system and thereby to further increase the pressure in the system. If a greater volume of water than the volume of water tank 54 was needed to raise the pressure of the flow system to the desired level, then valve 61 was opened, and additional water was pumped through line 60 and into dump tank 44. When the pressure of the flow system reached the desired pressure, valves 53 and 61 were closed.

A Ruska pump 1 was used to pump the hydrocarbon fraction and water into pipe reactor 16. The Ruska pump 1 contained two 250-milliliter barrels (not shown), with the hydrocarbon fraction being loaded into one barrel and water into the other, at ambient temperature and atmospheric pressure. Pistons (not shown) inside these barrels are manually turned on until the pressure in each barrel equaled the pressure of the flow system. When the pressures in the barrels and in the flow system were equal, check valves 4 and 5 opened to admit hydrocarbon fraction and water from the barrels to flow through lines 2 and 3. At the same time, valve 72 was closed to prevent flow in line 70 between points 12 and 78. Then the hydrocarbon fraction and water streams joined at point 10 at ambient temperature and at the desired pressure, flowed through line 11, and entered the bottom 17 of pipe reactor 16. The reaction mixture flowed through pipe reactor 16 and exited from pipe reactor 16 through side arm 24 at point 20 in the wall of pipe reactor 16. Point 20 was 19 inches fro bottom 17.

With solution flowing through pipe reactor 16, the furnace began heating pipe reactor 16. During heat-up of pipe reactor 16 and until steady state conditions were achieved, valves 26 and 34 were closed, and valve 43 was opened to permit the mixture in side arm 24 to flow through line 42 and to enter and be stored in dump tank 44. After steady state conditions were achieved, valve 43 was closed, and valve 34 was opened for the desired period of time to permit the mixture in side arm 24 to flow through line 33 and to enter and be stored in product receiver 35. After collecting a batch of product in product receiver 35 for the desired period of time, valve 34 was closed, and valve 26 was opened to permit the mixture in side arm 24 to flow through line 25 and to enter and be stored in product receiver 27 for another period of time. Then valve 26 was closed.

The material in side arm 24 was a mixture of gaseous and liquid phases. When such mixture entered dump tank 44, product receiver 35, or product receiver 27, the gaseous and liquid phases separated, and the gases exited from dump tank 44, product receiver 35, and product receiver 27 through lines 47, 38, and 30, respectively, and passed through line 70 and Annin valve 82 to a storage vessel (not shown).

When more than two batches of product were to be collected, valve 29 and/or valve 37 was opened to remove product from product receiver 27 and/or 35, respectively, to permit the same product receiver and/or receivers to be used to collect additional batches of product.

At the end of a run — during which the desired number of batches of product were collected — the temperature of pipe reactor 16 was lowered to ambient temperature, and the flow system was depressurized by opening valve 84 in line 85 venting to the atmosphere.

Diaphragm 76 measured the pressure differential across the length of pipe reactor 16. No solution flowed through line 74.

The API gravity of the liquid hydrocarbon products collected was measured, and their nickel, vanadium, and iron contents were determined by x-ray fluorescence.

The properties of the straight tar sands oil feed employed in Examples 15–24 are shown in Table 1. The tar sands oil feed contained 300–500 parts per million of iron, and the amount of 300 parts per million was used to determine the percent iron removed from the product. The experimental conditions and characteristics of the products formed in these Examples are presented in Table 5.

TABLE 5

| | Example 15 | Example 16 | Example 17 | Example 18 | Example 19 | Example 20 | Example 21 | Example 22 | Example 23 | Example 24 |
|---|---|---|---|---|---|---|---|---|---|---|
| Reaction pressure[1] | 4100 | 4040 | 4060 | 4080 | 4100 | 4100 | 4100 | 4100 | 4020 | 4040 |
| LHSV[2] | 1.0 | 1.0 | 1.0 | 1.0 | 2.0 | 2.0 | 2.0 | 2.0 | 2.0 | 2.0 |

TABLE 5-continued

| | Example 15 | Example 16 | Example 17 | Example 18 | Example 19 | Example 20 | Example 21 | Example 22 | Example 23 | Example 24 |
|---|---|---|---|---|---|---|---|---|---|---|
| Oil-to-water volumetric flow rate ratio | 1:3 | 1:3 | 1:3 | 1:3 | 1:2 | 1:2 | 1:3 | 1:3 | 1:3 | 1:3 |
| Packing material | alundum | Ru, Ti | Ru, Ti | Ru, Ti | alundum | alundum | alundum | alundum | Ru, Ti | Ru, Ti |
| Product collected during period number[3] | 3 | 2 | 4 | 5 | 1 | 2 | 1 + 2 | 3 | 2 | 3 |
| Product characteristics | | | | | | | | | | |
| API gravity[4] | 21.0 | 21.0 | 23.0 | 20.0 | 17.8 | 17.3 | 21.0 | 22.9 | 20.0 | 20.0 |
| Percent nickel removed | 95 | 77 | 84 | 69 | 97 | 69 | 64 | 69 | 69 | 93 |
| Percent vanadium removed | 97 | 81 | 96 | 99 | 59 | 54 | 73 | 59 | 60 | 77 |
| Percent iron removed | 98 | 99 | 98 | 92 | — | — | 99 | 99 | 98 | 98 |

Footnotes
[1] Pounds per square inch guage.
[2] Hours$^{-1}$.
[3] The number indicates the 7–8 hour period after start-up and during which feed flowed through pipe reactor 16.
[4] °API.

The liquid hourly space velocity (LHSV) was calculated by dividing the total volumetric flow rate, in milliliters per hour, of water and oil feed passing through pipe reactor 16 by the volumetric free space in pipe reactor 16—that is, 6 milliliters.

The above examples are presented by way of illustration, and the invention should not be construed as limited thereto.

The various components of the catalyst system of the method of this invention do not possess exactly identical effectiveness. The most advantages selection of components and concentrations thereof in the particular catalyst system to be used will depend on the particular hydrocarbon feed being processed.

We claim:

1. A process for cracking, desulfurizing, and demetalating a hydrocarbon fraction containing paraffins, olefins, olefin-equivalents, or acetylenes, as such or as substituents on ring compounds, and sulfurous and metallic components: comprising cracking, desulfurizing, and demetalating said hydrocarbon fraction by contacting said hydrocarbon fraction with a water-containing fluid at a temperature in the range of from about 600°F. to about 900°F., under super-atmospheric pressure, in the absence of externally supplied hydrogen, and in the presence of an externally supplied sulfur-resistant catalyst selected from the group consisting of at least one basic metal carbonate, basic metal hydroxide, transition metal oxide, oxide-forming transition metal salt, and combinations thereof, wherein the metal in the basic metal carbonate and hydroxide is selected from the group consisting of alkali metals, wherein the transition metal in the oxide and salt is selected from the group consisting of a transition metal of Group IVB, VB, VIB, and VIIB of the Periodic Chart, and wherein sufficient water is present in the water-containing fluid and said pressure is sufficiently high so that the water in the water-containing fluid has a density of at least 0.10 gram per milliliter and serves as an effective solvent for the hydrocarbon fraction; and lowering said temperature or pressure or both to thereby make the water in the water-containing fluid a less effective solvent for the hydrocarbon fraction and to thereby form separate phases, wherein essentially all the sulfur separated from the hydrocarbon fraction is in the form of elemental sulfur.

2. The process of claim 1 wherein the density of water in the water-containing fluid is at least 0.15 gram per milliliter.

3. The process of claim 2 wherein the density of water in the water-containing fluid is at least 0.2 gram per milliliter.

4. The process of claim 1 wherein the temperature is at least 705°F.

5. The process of claim 1 wherein the hydrocarbon fraction and water-containing fluid are contacted for a period of time in the range of from about 1 minute to about 6 hours.

6. The process of claim 5 wherein the hydrocarbon fraction and water-containing fluid are contacted for a period of time in the range of from about 5 to about 3 hours.

7. The process of claim 6 wherein the hydrocarbon fraction and water-containing fluid are contacted for a period of time in the range of from about 10 minutes to about 1 hour.

8. The process of claim 1 wherein the weight ratio of hydrocarbon fraction-to-water in the water-containing fluid is the range of from about 1:1 to about 1:10.

9. The process of claim 6 wherein the weight ratio of hydrocarbon fraction-to-water in the water-containing fluid is in the range of from about 1:2 to about 1:3.

10. The process of claim 1 wherein the hydrocarbon fraction is contacted with the water-containing fluid in the absence of pretreatment of the hydrocarbon fraction.

11. The process of claim 1 wherein the transition metal in the oxide and salt is selected from the group consisting of vanadium, chromiun, manganese, iron, titanium, molybdenum, copper, zirconium, niobium, tantalum, rhenium, and tungsten.

12. The process of claim 11 wherein the transition metal in the oxide and salt is selected from the group consisting of chromium, mangenese, titanium, tantalum, and tungsten.

13. The process of claim 1 wherein the water-containing fluid is water.

14. The process of claim 1 wherein the metal in the basic metal carbonate and hydroxide is selected from the group consisting of sodium and potassium.

15. The process of claim 1 wherein the catalyst is present in a catalytically effective amount which is equivalent to a concentration level in the water in the water-containing fluid in the range of from about 0.01 to about 3.0 weight percent.

16. The process of claim 15 wherein the catalyst is present in a catalytically effective amount which is equivalent to a concentration level in the water in the water-containing fluid in the range of from about 0.10 to about 0.50 weight percent.

17. The process of claim 1 wherein the water-containing fluid is substantially water.

* * * * *

UNITED STATES PATENT OFFICE

CERTIFICATE OF CORRECTION

Patent No. 3,960,708 Dated June 1, 1976

Inventor(s) JOHN D. McCOLLUM and LEONARD M. QUICK

It is certified that error appears in the above-identified patent and that said Letters Patent are hereby corrected as shown below:

Column 2, line 46, "metal-containing containing" should be --metal-containing--.

Column 3, line 59, "acid" should be --acidic--.

Column 3, line 59, "havin" should be --having--.

Column 4, line 42, "theaded" should be --treated--.

Column 4, line 50, "and" should be --said--.

Column 5, line 17, "Density" should be --The density--.

Column 5, line 35, "VB VIB" should be --VB, VIB--.

Column 5, line 35, "in" should be --of--.

Column 5, line 68, "hydrocargon" should be --hydrocarbon--.

Column 6, line 4, "orde" should be --order--.

Column 6, line 34, "sense-water" should be --dense-water--.

Column 7, line 46, "rasie" should be --raise--.

Column 7, line 46, "of" should be --from--.

Column 7, line 58, "vessel." should be --vessel,--.

Column 7, line 63, "where" should be --were--.

UNITED STATES PATENT OFFICE

CERTIFICATE OF CORRECTION

Patent No. 3,960,708 Dated June 1, 1976

Inventor(s) JOHN D. McCOLLUM and LEONARD M. QUICK

It is certified that error appears in the above-identified patent and that said Letters Patent are hereby corrected as shown below:

Column 8, line 44, "extend" should be --extent--.

Column 8, line 45, "with" should be --when--.

Column 11, line 25, "Pile" should be --Pipe--.

Column 11, line 37, "arbon" should be --argon--.

Column 11, line 58, "are" should be --were--.

Column 12, line 11, "fro" should be --from--.

Column 13, line 30, "advantages" should be --advantageous--.

Column 14, line 28, "5 to" should be --5 minutes to--.

Column 14, line 51, "mangenese" should be --manganese--.

Signed and Sealed this

*Thirty-first* Day of *August 1982*

[SEAL]

*Attest:*

GERALD J. MOSSINGHOFF

*Attesting Officer* *Commissioner of Patents and Trademarks*